US005762001A

United States Patent [19]

Dworakowski

[11] Patent Number: 5,762,001

[45] Date of Patent: Jun. 9, 1998

[54] DOOR EDGE PROTECTOR

[75] Inventor: Peter S. Dworakowski, Mokena, Ill.

[73] Assignee: Thrall Car Manufacturing Company, Chicago Heights, Ill.

[21] Appl. No.: 807,966

[22] Filed: Feb. 28, 1997

Related U.S. Application Data

[63] Continuation of Ser. No. 484,785, Jun. 7, 1995, abandoned.

[51] Int. Cl.[6] ..... B61D 49/00

[52] U.S. Cl. ..... 105/355; 105/404

[58] Field of Search ..... 105/355, 374, 105/423, 404; 410/3, 127, 129, 121; 296/39.1, 191; 267/140, 139; 52/630, 33

[56] References Cited

U.S. PATENT DOCUMENTS

| | | | |
|---|---|---|---|
| 2,843,889 | 7/1958 | Keller | 20/74 |
| 3,418,815 | 12/1968 | Kumazawa | 267/140 |
| 3,876,082 | 4/1975 | Fehl et al. | 267/140 |
| 4,245,863 | 1/1981 | Carte | 105/423 |
| 4,555,885 | 12/1985 | Raymond et al. | 52/468 |
| 4,756,266 | 7/1988 | Sakuraoka | 267/140 |
| 4,913,061 | 4/1990 | Youngblood | 105/378 |
| 4,964,347 | 10/1990 | Long et al. | 105/404 |
| 5,085,545 | 2/1992 | Takahashi | 411/45 |
| 5,239,933 | 8/1993 | Murphy et al. | 105/374 |
| 5,311,823 | 5/1994 | Rudibaugh et al. | 105/355 |
| 5,415,108 | 5/1995 | Murphy et al. | 105/355 |

FOREIGN PATENT DOCUMENTS

| | | | |
|---|---|---|---|
| 086 959 A1 | 8/1983 | European Pat. Off. | B60R 13/06 |
| 1275892 | 8/1968 | Germany | 296/39.1 |
| 39 09 277 A1 | 10/1989 | Germany | B60J 5/04 |

OTHER PUBLICATIONS

Drawing #4M–055–2, dated Jun. 7, 1984, entitled "Protection Appliction".

Drawing #4M–055–12, Rev. E, dated Aug. 30, 1990, entitled "Vehicle Production Multi Level Auto Rack Tape Bi Level Application Locations".

Drawing #4M–055–16, dated Mar. 26, 1991, entitled "Protection Application (Attached By Screws)".

Drawing #4M–055–18, dated Jul. 5, 1991, entitled: "Door Protection 2" Strap—B.N. for 20'–2"Tri–Level".

Drawing #5M–055–0040, dated Mar. 9, 1995, entitled "Bi–Level Assembly".

*Primary Examiner*—Mark T. Le

*Attorney, Agent, or Firm*—Fitch, Even, Tabin & Flannery

[57] ABSTRACT

A bumper panel having first and second attachment surfaces, a contact plateau and first and second sloped surfaces attaching the attachment surfaces to the contact plateau for application in an autorack railcar wherein the bumper panel is disposed to cushion the impact between a vehicle door edge and the side walls of the railcar.

7 Claims, 7 Drawing Sheets

10
14
21
20
16
40
26
22
50
12
32
30
36
58
57
56
52
34
54
24
28
18
19

28

40

36
80
80
72

62
78
78
60
70
36
72
78
80
62
60
80
78

86
82
88
84
86

86
84
82

92
90

96
96
94
94
92
90

Fig. 13A
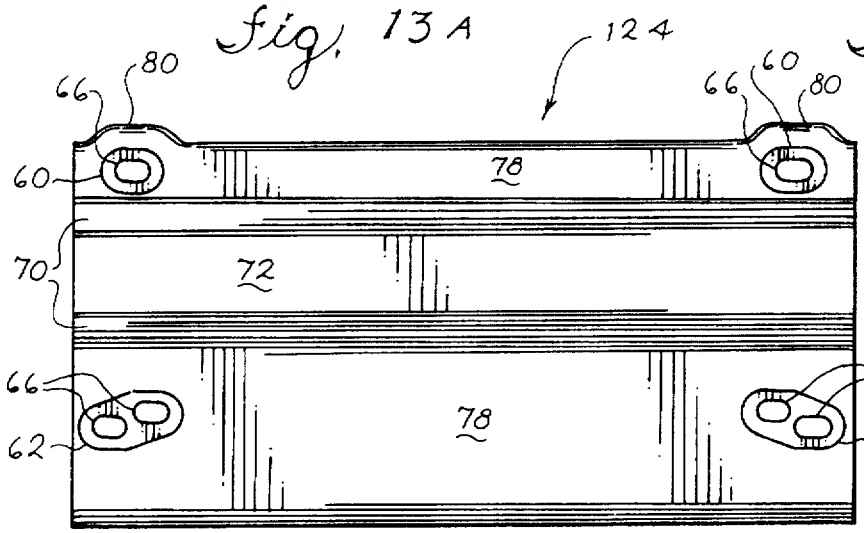
Fig. 13B
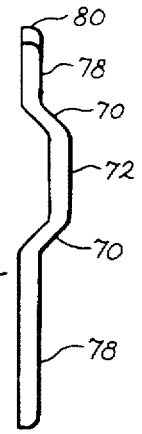
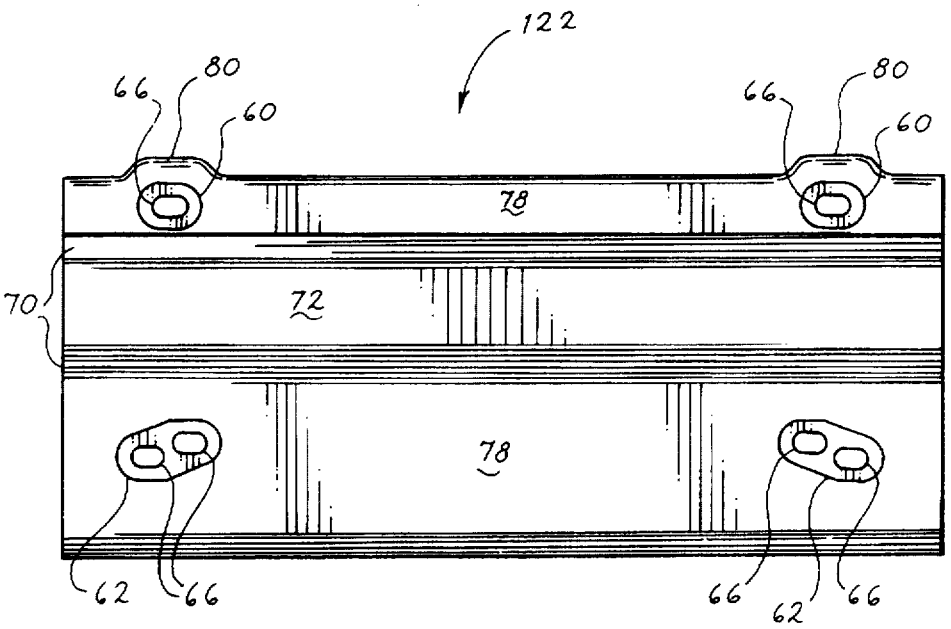
Fig. 14A
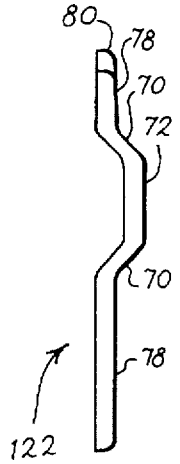
Fig. 14B

Fig. 15A
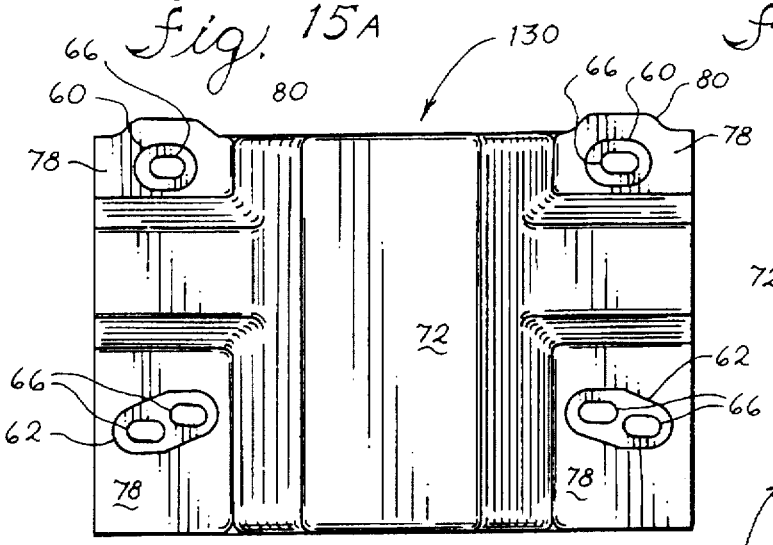
Fig. 15B
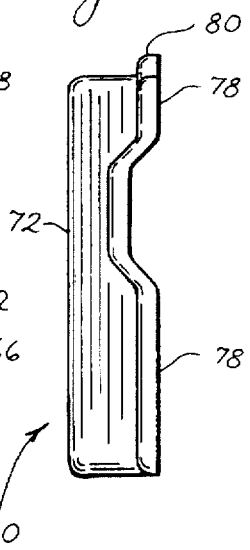
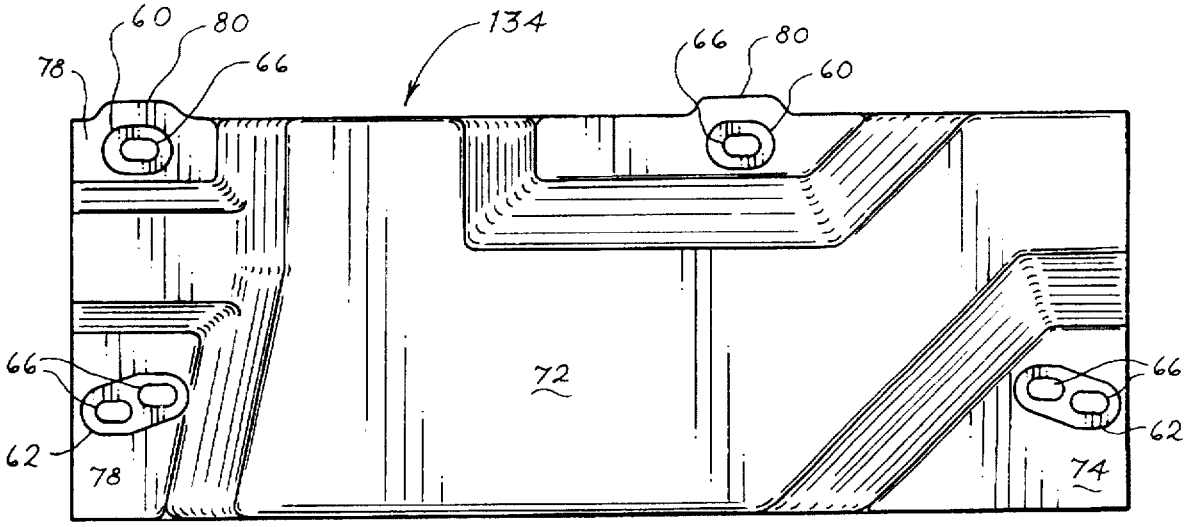
Fig. 16A
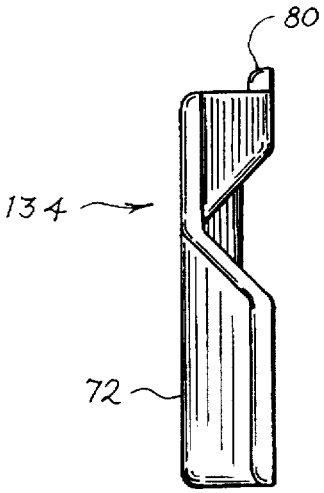
Fig. 16B

DOOR EDGE PROTECTOR

This application is a continuation of application Ser. No. 08/484,785, filed Jun. 7, 1995 now abandoned.

BACKGROUND OF THE INVENTION

This invention relates to door edge protectors, and, more particularly, to protective devices placed inside autorack railroad cars to protect against direct impact between the door of a vehicle within the autorack car and the side wall of the autorack car when the vehicle door swings open, and thus, to inhibit damage to the car.

Railroad cars are widely used in the United States and other countries to transport vehicles such as automobiles, trucks and the like from manufacturing plants to distribution centers. Such railroad cars are referred to in the trade as autoracks. An example of a prior art autorack car is described in U.S. Pat. No. 3,426,704, entitled "Deck Section Lock Structure".

Autorack cars typically include a pair of side walls comprising a number of substantially rectangular, perforated side panels fixed between a series of vertical posts. Between adjacent vertical posts, a number of panels may span the height of the car, from the roof-supporting roof rail at the top to the load-bearing side sills at the bottom. The side panels are typically perforated so that exhaust fumes from the vehicles do not accumulate to an unacceptable level during the loading and unloading of the vehicles. The side panels also may be corrugated for increased rigidity and are generally supported by metal plates or brackets extending from the vertical posts. The side panels typically do not abut each other, but rather are sized to leave a small horizontal gap between vertically adjacent side panels or between a side panel and a roof rail or side sill. The side panels are also sized to permit a small gap between the vertical edges of the side panel and the vertical posts between which the side panel is disposed. An example of a sidewall comprising vertically adjacent panels is described in U.S. Pat. No. 4,936,227, entitled "End Door For Rail Car."

One problem that has arisen with the use of such autorack cars has been that those who are loading and unloading the vehicles into the cars sometimes cause damage to the vehicles by opening the vehicle doors far enough that the edge of the vehicle door strikes the metallic side wall of the autorack car. If sufficient force is used, this contact may scratch the paint off the cars or otherwise damage the finish, or may even dent the doors of the vehicle.

Some have attempted to allay this problem by applying mastic-backed tape along the inside of the autorack side wall. These attempts have been largely unsuccessful for a number of reasons. In particular, the tape may not adhere well to the side wall, particularly in response to extreme weather conditions, the tape has a very limited functional duration, and when the side panels are eventually removed for regalvanization, the tape must be completely and expensively removed by applying a special solvent to the remaining adhesive.

Others have stretched a nylon belt or rubber hose completely across the length of the autorack car, supported by the ends of the car and supports attached to the vertical posts. Many such belts or hoses have covered an insufficient area of the side wall to insure against direct metal-to-metal contact for different sized vehicles. Further, such belts have stretched and lost tension over time, causing the belts to sag and lose their ability to prevent contact between the vehicle doors and the side walls. Efforts to repeatedly retension the belts by ratcheting, and subsequently replacing the belts have proven expensive.

Methods such as attaching large rubber mats to the side wall panels and coating the side wall panels with a thin layer of spray-on foam have also failed to provide adequate protection for the vehicle doors. Furthermore, due to regulations regarding the cross-sectional size and shape of railroad cars, the autoracks cannot be widened so that the vehicle doors cannot reach the sides of the autorack car. Thus, feasible solutions must be substantially limited to the constraints of current autorack cars.

SUMMARY OF THE INVENTION

In accordance with the present invention, there is provided a series of bumper panels and related assembly for attaching the bumper panels along the interior of an autorack railroad car. The bumper panels serve to cushion the impact between a door edge of a vehicle and one of the side walls. At least one of the bumper panels comprises an attachment surface attachable to one of the side walls of the autorack car, a contact plateau disposed substantially perpendicularly to the decks of the autorack car, and a surface extending from the attachment surface to the contact plateau. The bumper panel is disposed within the autorack car such that the contact plateau is generally more proximate to the center of the autorack car than is the attachment surface, thus facilitating the contact plateau to first contact a vehicle door edge which is swung open from inside the car and inhibit the door edge from striking the generally metallic sides of the autorack car.

BRIEF DESCRIPTION OF THE DRAWINGS

FIG. 13A is a front elevational view of a short bumper panel for a bi-level autorack car.

FIG. 13B is a left side elevational view of a short bumper panel for a bi-level autorack car.

FIG. 14A is a front elevational view of a long bumper panel for a bi-level autorack car.

FIG. 14B is a left side elevational view of a long bumper panel for a bi-level autorack car.

FIG. 15A is a front elevational view of a post bumper panel for a bi-level autorack car.

FIG. 15B is a right side elevational view of a post bumper panel for a bi-level autorack car.

FIG. 16A is a front elevational view of a left cross-brace bumper panel for a bi-level autorack car.

FIG. 16B is a right side elevational view of a left cross-brace bumper panel for a bi-level autorack car.

DETAILED DESCRIPTION OF PREFERRED EMBODIMENTS

The invention is preferably embodied as a bumper panel assembly for cushioning the impact between the door edge of a vehicle located on an autorack railroad car and the side wall of the car.

Figure 1:
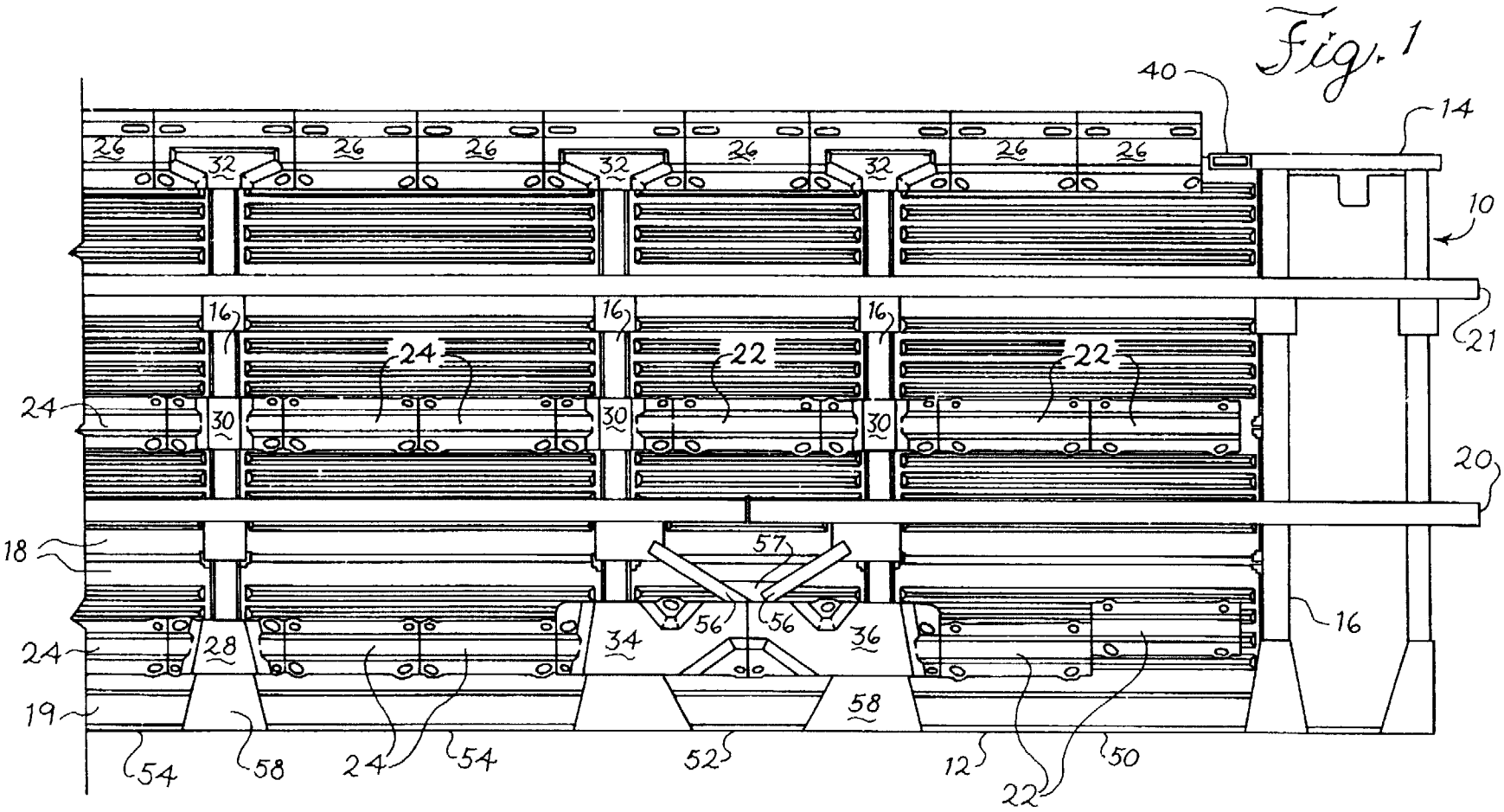
FIG. 1 is a schematic elevational view from inside a tri-level autorack car showing the location and orientation of bumper seals along a side wall thereof.
Figure 12:
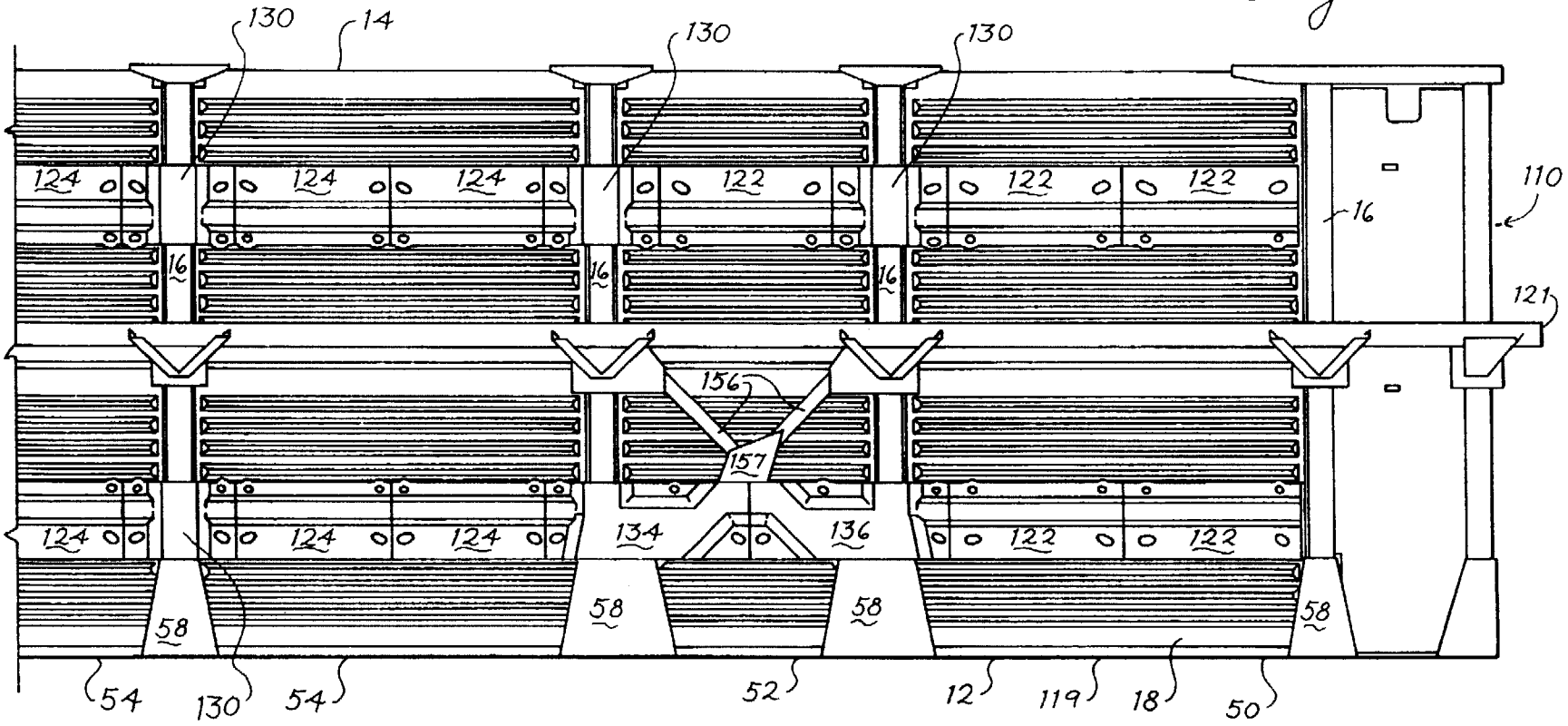
FIG. 12 is a schematic elevational view from inside a bi-level autorack car showing the location and orientation of bumper seals along a side wall thereof.

The railroad car is preferably a tri-level or bi-level autorack car, examples of which are schematically depicted in FIGS. 1 and 12 respectively. The car may extend longitudinally between a pair of wheel trucks and comprises a support structure including a pair of vertical side walls which are supported by side sills. The car typically includes a roof, supported by a pair of roof rails extending along the tops of the side walls. The side walls may include a series of spaced vertical posts extending from the side sills up to the roof rails, with one or more side panels supported and vertically aligned between adjacent posts. The posts may be supported at the side sills by trapezoidal post supports and at the roof rails by triangular post supports.

The side panels preferably have many perforations therein so that when vehicles are driven into the railroad cars, carbon monoxide produced by the vehicles may escape. The non-peripheral portions of the panels may also be corrugated for increased bending rigidity.

Where more than one side panel is present between adjacent posts, as in FIGS. 1 and 12, there may be a top side panel disposed vertically adjacent to the roof rail, a bottom side panel disposed vertically adjacent to the side sill, and a number of adjacent intermediate panels disposed between the top side panel and the bottom side panel.

The side panels are preferably supported between the posts by metal brackets which extend from the posts. Due to the dimensions of the brackets, the side panels do not abut each other edgewise; nor do they contact the posts, the roof rails, or the side sills. Thus, between adjacent panels, an interpanel gap is formed. Between the top panel and the roof rail, a top gap is formed. Between the bottom panel and the side sill, a bottom gap is formed. Between the panels and the vertical posts, vertical gaps are formed.

The bumper panel system preferably comprises multiple levels of substantially continuous abutting bumper panels attached to each of the side walls at an appropriate height to inhibit contact between the vehicle door and the side wall of the autorack car when the vehicle door is swung open.

As seen in FIG. 1 the tri-level autorack car 10 has three decks for supporting vehicles thereon, a bottom deck 19 being supported by the side sills 12 and middle and top decks, 20 and 21 respectively, being supported at the vertical posts 16. Four rectangular side panels 18, each being corrugated and perforated in its non-peripheral region, are vertically aligned from the side sill 12 to the roof rail 14 between adjacent vertical posts 16.

The vertical posts 16 define car segments of varying lengths from one end of each symmetric autorack car 10 to the opposite end. The first and last sets of four side panels comprise the end segments 50 on each autorack car. The segments adjacent to the end segments 50 are the short segments 52. All the segments more central than the short segments 52 are intermediate segments 54. In the preferred embodiments, different combinations of bumper panels are employed within the various segments to most efficiently fill the space between the vertical posts 16.

Between the bottom deck 19 and middle deck 20, inside the short segment 52, cross-braces 56 provide additional stability to the autorack car, above the wheel trucks.

Figure 3A:
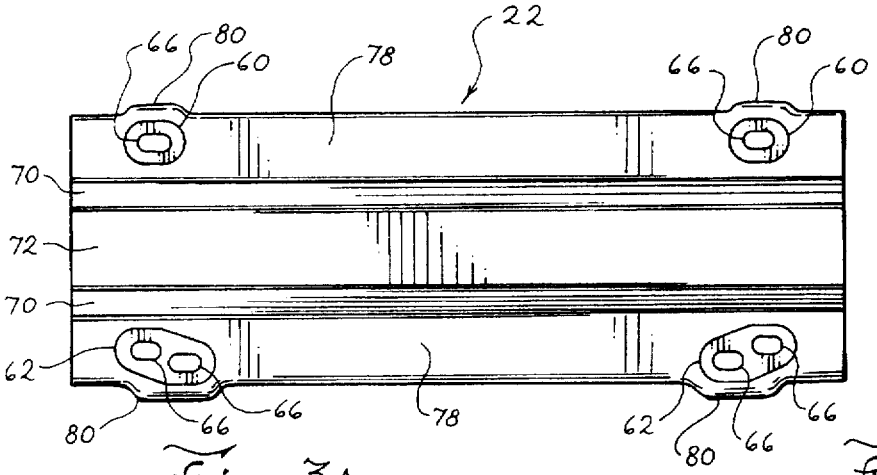
FIG. 3A is a front elevational view of a long bumper panel for a tri-level autorack car.
Figure 3B:
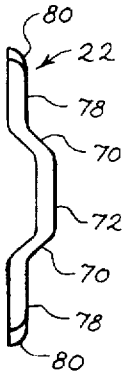
FIG. 3B is a left side elevational view of a long bumper panel for a tri-level autorack car.

Within the end segment 50, at an appropriate vehicle door height above the bottom deck 19, are two horizontally abutting long bumper panels 22 affixed to the side wall, in particular to the bottom side panel. The long bumper panels 22 are shown in greater detail in FIGS. 3A and 3B. The bumper panel 22 closest to the end of the car is slightly higher than the other because the ramps on which the vehicles are driven to enter and exit the autorack car are angled upward from the bottom deck 19, thereby raising the level of the center of the vehicle.

Above the middle deck 20, another two long bumper panels 22 horizontally abut, this time at the same height, and the panels 22 are affixed to both of the intermediate panels, spanning the gap therebetween.

Figure 4A:
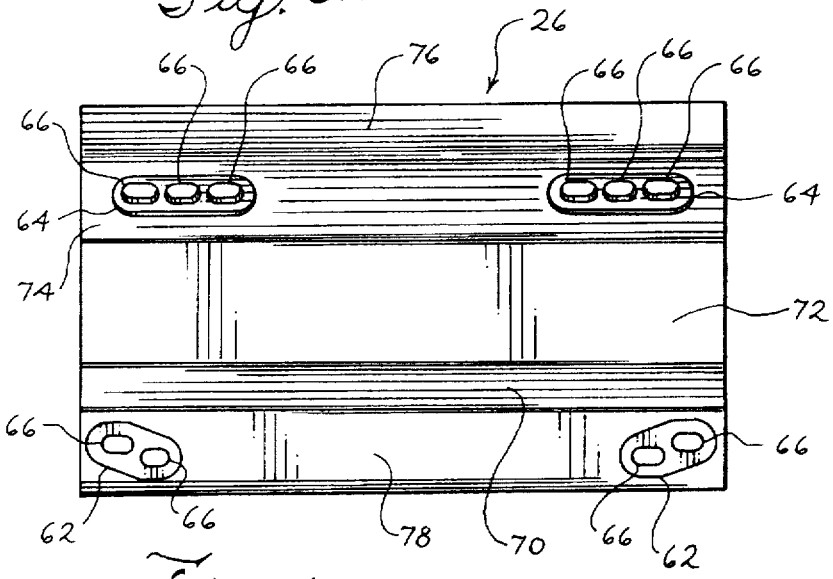
FIG. 4A is a front elevational view of a roof bumper panel for a tri-level autorack car.
Figure 4B:
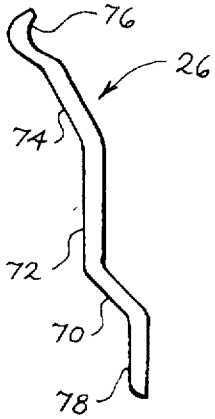
FIG. 4B is a right side elevational view of a roof bumper panel for a tri-level autorack car.

The vehicles that are supported by the top deck 21 have somewhat less space than those on the lower and middle decks because the geometric constraints of the autorack car requires that the top of the car be somewhat tapered. Thus, an opened vehicle door on the top deck 21 strikes higher off the supporting deck 21 than do vehicle doors on decks below. Two horizontally abutting roof bumper panels 26 which are attached to both the side wall (top side panel) and the autorack car roof are employed in the end segment 50. The roof bumper panels 26 are shown in greater detail in FIGS. 4A and 4B.

Figure 5A:
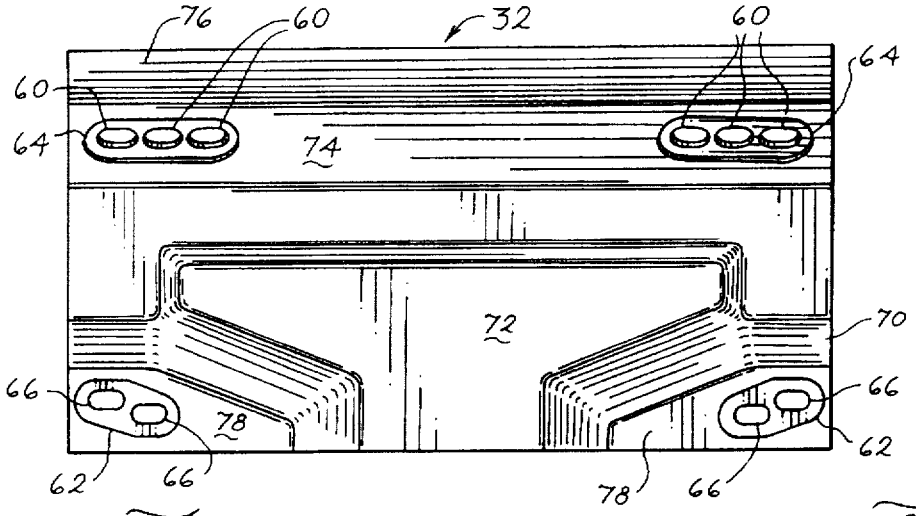
FIG. 5A is a front elevational view of an upper post bumper panel for a tri-level autorack car.
Figure 5B:
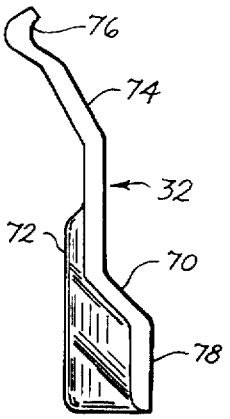
FIG. 5B is a right side elevational view of an upper post bumper panel for a tri-level autorack car.
Figure 6A:
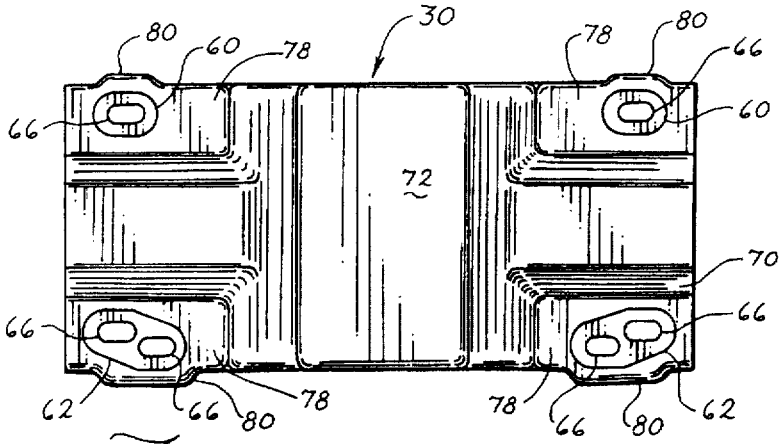
FIG. 6A is a front elevational view of a mid-post bumper panel for a tri-level autorack car.
Figure 6B:
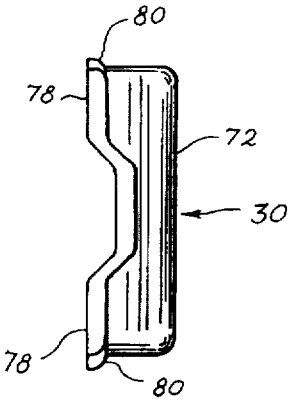
FIG. 6B is a left side elevational view of a mid-post bumper panel for a tri-level autorack car.

In order to cover the vertical post 16 between the end segment 50 and the short segment 52, there are specially fitted bumper panels attached at each level. Along the roof rail 14, an upper post bumper panel 32 abuts the roof bumper panels 26 on either side and fits over the junction between the post 16 and the roof rail 14. The upper post bumper panel 32 is depicted in greater detail in FIGS. 5A and 5B. Above the middle deck 20, the post 16 is covered by a mid-post bumper panel 30 which abuts adjacent bumper panels. The mid-post bumper panel 30 is shown in greater detail in FIGS. 6A and 6B.

Just above the bottom deck 19, the vertical posts which sandwich the short segment 52 are covered by abutting left and right cross-brace bumper panels, 34 and 36 respectively, which also cover the diagonal cross-brace members 56. The cross-brace bumper panels are shown in greater detail in FIGS. 8A and 8B. The short segment 52 also has one long bumper panel 22 spanning most of the middle level and one roof bumper panel 26 spanning the upper level.

Figure 2A:
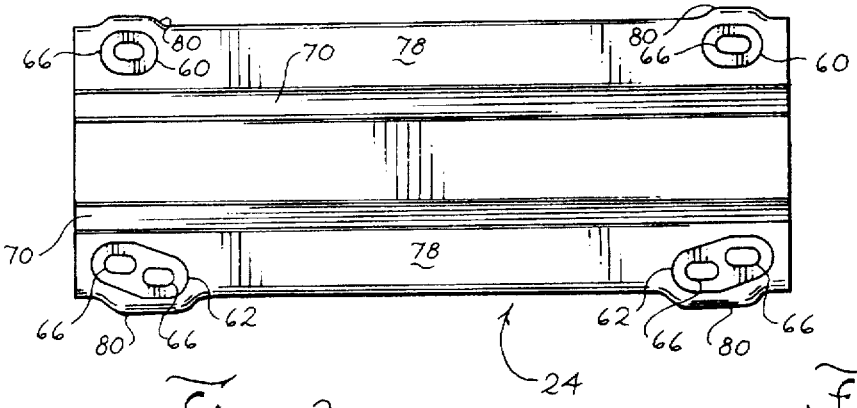
FIG. 2A is a front elevational view of a short bumper panel for a tri-level autorack car.
Figure 2B:
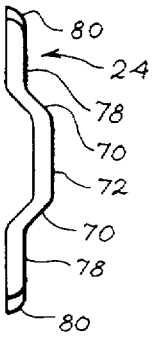
FIG. 2B is a left side elevational view of a short bumper panel for a tri-level autorack car.

Within the intermediate segments 54, two abutting short bumper panels 24 span most of both the middle and bottom levels. The short bumper panel 24 is depicted in greater detail in FIGS. 2A and 2B. Spanning most of the top level are two abutting roof bumper panels 26.

Figure 7A:
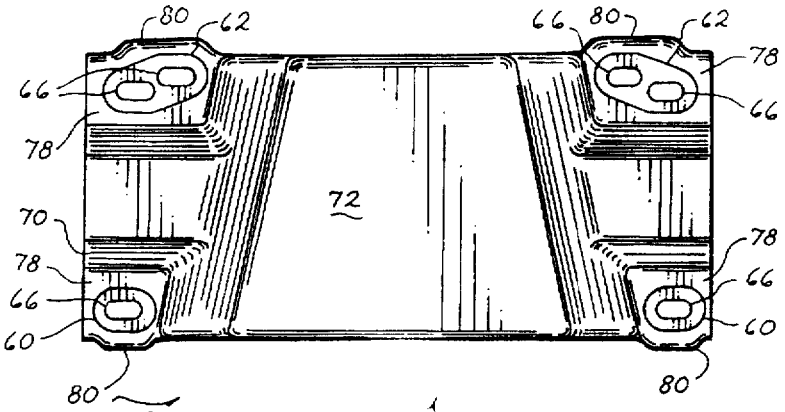
FIG. 7A is a front elevational view of a lower post bumper panel for a tri-level autorack car.
Figure 7B:
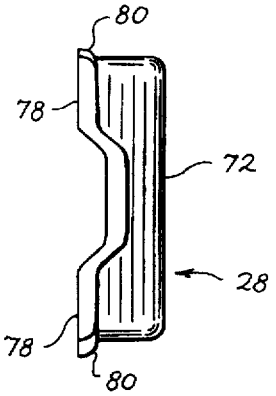
FIG. 7B is a left side elevational view of a lower post bumper panel for a tri-level autorack car.

Posts between intermediate segments 54 are covered on the top level and middle level as are the other posts. On the bottom level, there are no cross-brace members to account for, so a lower post bumper panel 28 is used to cover the post and trapezoidal post support 58. The lower post bumper panel 28 is shown in greater detail in FIGS. 7A and 7B.

Figures 8A, 8B, 9, 10A, 10B, 11A, 11B:
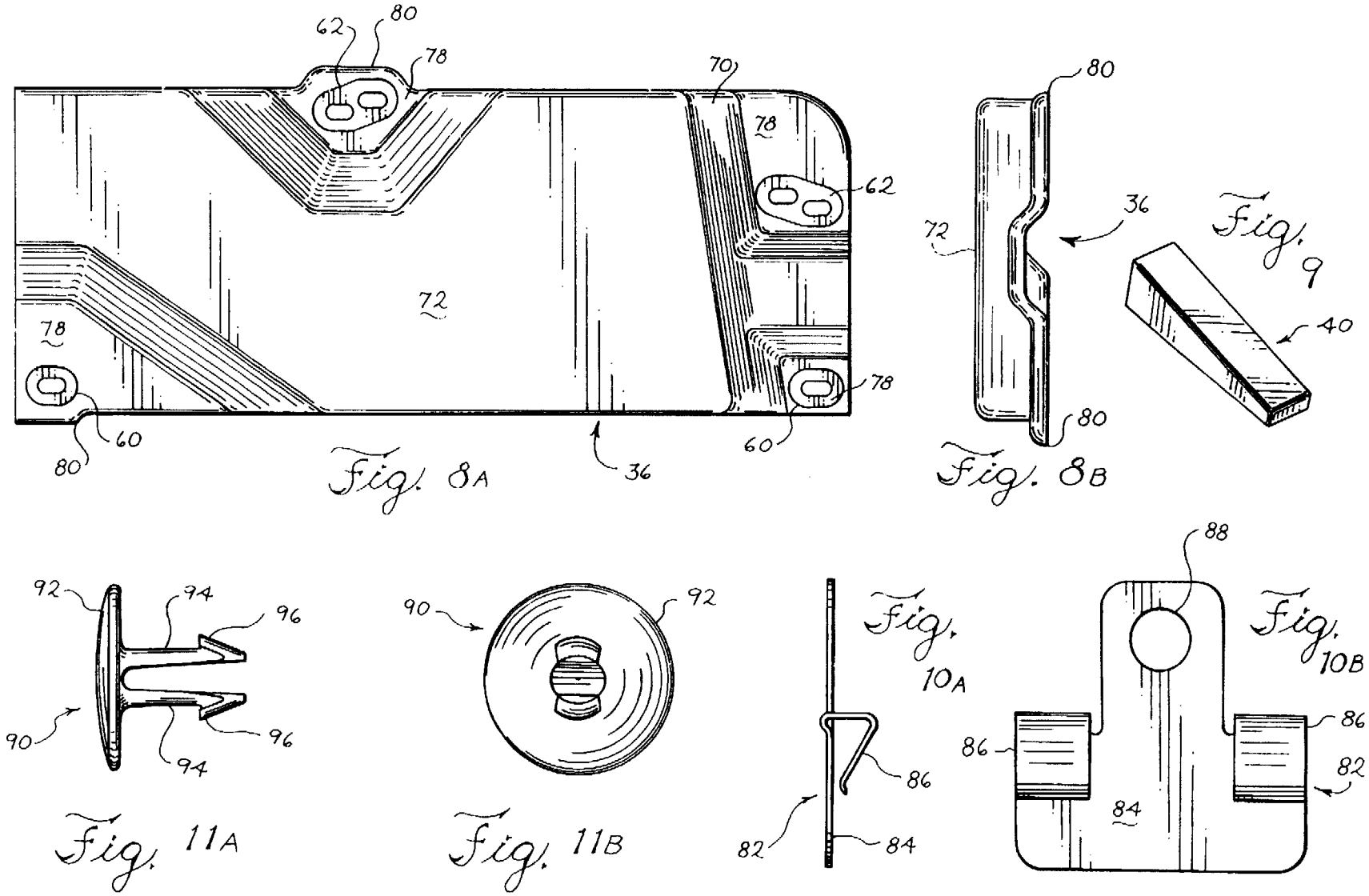
FIG. 8A is a front elevational view of a right cross-brace bumper panel for a tri-level autorack car.
FIG. 8B is a right side elevational view of a right cross-brace bumper panel for a tri-level autorack car.
FIG. 9 is a perspective view of a shear panel protector for a tri-level autorack car.
FIG. 10A is a left side elevational view of a roof panel clip for a tri-level autorack car.
FIG. 10B is a front elevational view of a roof panel clip for a tri-level autorack car.
FIG. 11A is a right side elevational view of a retainer button for a tri-level autorack car.
FIG. 11B is a rear elevational view of a retainer button for a tri-level autorack car.

As seen in FIG. 1, a shear panel protector 40 is attached along the roof rail 14 adjacent the end of the series of roof bumper panels 26, extending the length of protection along the roof rail 14. The shear panel protector 40, as seen in perspective in FIG. 9, is shaped as a truncated wedge and is preferably a deformable plastic piece which may absorb the energy of impact with a vehicle door.

Another preferred embodiment of the invention is for application in a bi-level autorack railroad car, as seen in FIG. 12. The basic construction of the bi-level car 110 is similar to that of the tri-level autorack, but only two decks are present, a bottom deck 119 at the level of the side sills 12 and a top deck 121 approximately half way up the height of the car 110. Both cars employ the same basic vertical post 16 and side panel 18 array structure. Because there is more vertical space between decks in the bi-level car, such a car may carry taller vehicles inside.

The preferred bumper panels employed in the bi-level car 110 are only slightly different than those of the tri-level car. In particular, the bumper panels just above the bottom deck 19 of the tri-level car 10 substantially correspond in length and type to those just above the bottom deck 119 of the bi-level car 110. Similarly, the bumper panels just above the middle deck 20 of the tri-level car 10 substantially correspond in length and type to those just above the top deck 21 in the bi-level car 110. Because the bi-level car 110 has more vertical space between decks, the roof bumper panels 26 and the upper post bumper panels 32 of the tri-level embodiment do not have analogs in the bi-level embodiment.

In particular, within the end segment 50 of the bi-level car 110, two abutting long panels 122 span most of the segment at both levels. The bi-level embodiments of the long panels 122 are shown in greater detail in FIGS. 14A and 14B. All vertical posts 16 are covered on the upper level by post bumper panels 130. The posts are also covered by post bumper panels 130 on the lower level where there are no cross-brace members 156 supported by the post. The post bumper panel 130 is depicted in greater detail in FIGS. 15A and 15B.

As in the tri-level car, both posts adjacent the short segment 52 support cross-brace members 156. Therefore, at the lower level it is preferable to cover the trapezoidal post supports 58, the posts 16, the cross-brace members 156 and part of the cross-brace plate 157. Thus, as seen in FIG. 12, left and right cross-brace bumper panels 134 and 136, respectively, are used on the lower level of the bi-level car 110 at the posts 16 adjacent to the short segment 52.

Referring generally now to FIGS. 2A, 2B, 3A, 3B, 4A, 4B, 5A, 5B, 6A, 6B, 7A, 7B, 8A, 8B, 13A, 13B, 14A, 14B, 15A, 15B, 16A, and 16B, which depict variously shaped bumper panels, there are several features common to a number of these bumper panels.

All the bumper panels in the inventive bumper panel system have at least one attachment surface 78 which, when the bumper panel is installed on the autorack car, will substantially contact one of the side panels 18. Furthermore, all such bumper panels have a contact plateau 72 which is substantially perpendicular to the ground and the decks of the autorack car. The contact plateau 72 usually serves as the first and primary region of contact for the vehicle door as it is swung open, and thus usually protrudes the farthest toward the center of the car. The contact plateau 72, which should not contact the side wall of the autorack directly when unbiased, can deform to absorb most, or preferably all, of the energy of the swung door, before the contact plateau 72 deforms sufficiently to contact the side wall.

The contact plateau 72 on each bumper panel is translated out of the plane of the attachment surface 78 by at least one substantially sloped surface 70. The sloped surface 70, like all the other parts of the bumper panels, is preferably integral with adjacent sections of the panel. Also, it is within the scope of the invention that the sloped surface 70 be non-planar, such as for example, if it were substantially cylindrical or even spherical. In light of this, it is intended that the term "sloped" in the claims should not be restricted to planar surfaces. Likewise, the sloped surface 70 need not extend monotonically from the attachment surface 78 to the contact plateau 72. Rather, there may be intermittent regions within the sloped surface 70 where the gradient reverses or mathematical "saddle points" exist.

Installment of the bumper panels may be performed in a number of ways, but preferably, the attachment surface will have at least one opening or slot 66 therein which may be aligned with a perforation in one of the side panels 18 so that a retainer button may be inserted through the aligned slot 66 and perforation. FIGS. 11A and 11B show the preferred retainer button in detail.

The legs 94 of the preferred button 90 are forced through the slot 66, the edges of the slot 66 and the perforation forcing the barbed ends 96 of the button 90 relatively closer to one another. As the head of the button 92 comes flush with the attachment surface 78 around the edges of the slot 66, the barbed end 96 emerges from the perforation, permitting the legs 94 to biasedly separate. Thus, the barbed ends 96 and the head 92 of the button 90 prevent the button 90 from sliding in either direction. The shape of the preferred button is not considered to limit the scope of the invention, and other types of fasteners or attachment mechanisms, such as bolts and the like, may be used within the scope of the invention.

Preferably, the slot 66 is within a countersink in the bumper panel so that the head 92 of the button 90 does not protrude from the plane of the attachment surface 78 after the bumper panel is installed. In the preferred embodiments, three types of countersinks are used, though others would also be acceptable. Where there is a single slot 60, a single-slot countersink 60 is employed. Where two slots 60 are present, a double-slot diagonal countersink 62 is used. The diagonal countersink 62 permits the two slots 60 therein to be at different levels, facilitating better alignment with a perforation in the corresponding side panel. In some bumper panels, as seen from the figures, the position of the countersink necessitates an extending ear 80 around the countersink.

The roof bumper panel 26 and the upper post bumper panel 32 which are attached to the roof of the car as well as to one of the side panels have additional parts for attaching to the roof. These panels, 26 and 32, are shown in detail in FIGS. 4A and 4B and 5A and 5B.

Each panel 26, 32 preferably has a sloped attachment surface 74 which is oblique to the contact plateau 72 and angles inwardly toward the center of the car 10 as well as upwardly toward the roof. Within the sloped attachment surface 74 there are two triple-slot horizontal countersinks 64, each such countersink 74 housing three linearly adjacent slots 66. These slots 66 may be aligned with the hole 88 in the roof panel clip 82. The roof panel clip 82 is shown in FIGS. 10A and 10B.

This alignment permits the panels 26 and 32 to be attached to the roof panel clip 82, which in turn is attached to the roof rail 14. The hook arms 86 of the clip 82 engage the roof rail 14 so that the hole 88 extends upwardly into alignment with one of the three slots 66 in the triple-slot countersink 64. At the remote end of the sloped attachment surface 74 from the contact plateau 72 is an integral hook 76 for providing support against the roof of the car 10.

The bumper panels may be made of a number of materials, but should be deformable and resilient. Preferably, the bumper panels are injection molded from UV-stabilized, black, retardant Kaneka Energy Absorbing Foam. Similarly, the size of the bumper panels may vary considerably within the scope of the invention. Preferably, however, they are approximately 15 inches tall in the tri-level embodiment and approximately 20 inches tall in the bi-level embodiment. Preferably, the contact plateau is approximately 4.5 inches tall in both the tri-level and bi-level embodiments.

The invention is further described in the following claims.

What is claimed is:

1. In an autorack railcar where said autorack railcar comprises a pair of opposing side walls having vertical posts and a plurality of side wall panels having wall surfaces, said side walls defining a railcar interior therebetween, and a plurality of substantially parallel decks for supporting vehicles thereon, a plurality of bumper panels being effective to cushion the impact between a door edge of one of said vehicles and one of said side walls of said autorack railcar, each said bumper panel comprising:

a substantially planar first attachment surface attachable to said one of said side walls;

a substantially planar second attachment surface attachable to said one of said side walls;

a substantially planar contact plateau disposed between said first and second attachment surfaces and substantially perpendicularly to said decks such that said contact plateau is more proximate to the center of said railcar than is said first attachment surface, said contact plateau being disposed between said first and second attachment surfaces;

a first sloped surface extending from said first attachment surface to said contact plateau; and a second sloped surface extending from said second attachment surface to said contact plateau wherein said sloped surfaces and said contact plateau form an open channel having its opening toward said one of said side walls;

said attachment surfaces being joined to said wall surfaces;

said channels receiving portions of said vertical posts.

2. A bumper panel in accordance with claim 1 wherein said second attachment surface is substantially coplanar with said first attachment surface.

3. A bumper panel in accordance with claim 1 wherein said first attachment surface defines a first slot therein such that a retainer button may be inserted through said first slot and a perforation in said side wall to substantially affix said first attachment surface to said side wall.

4. A bumper panel in accordance with claim 3 wherein said first attachment surface further defines a countersink around said first slot.

5. A bumper system in accordance with claim 1 wherein said contact plateau is disposed to cushion the impact between said door edge and one of said vertical posts.

6. A bumper panel in accordance with claim 3 further comprising a retainer button inserted through said first slot and through said perforation in said side wall to substantially affix said first attachment surface to said side wall.

7. In an autorack railcar where said autorack railcar comprises a pair of opposing side walls having vertical posts, said side walls defining a railcar interior therebetween, and a plurality of substantially parallel decks for supporting vehicles thereon, a bumper panel being effective to cushion the impact between a door edge of one of said vehicles and one of said side walls of said autorack railcar, said bumper panel comprising:

a substantially planar first attachment surface attachable to said one of said side walls;

a substantially planar second attachment surface attachable to said one of said side walls;

a substantially planar contact plateau disposed between said first and second attachment surfaces and substantially perpendicularly to said decks such that said contact plateau is more proximate to the center of said railcar than is said first attachment surface, said contact plateau being disposed between said first and second attachment surfaces;

a first sloped surface extending from said first attachment surface to said contact plateau; and a second sloped surface extending from said second attachment surface to said contact plateau wherein said sloped surfaces and said contact plateau form an open channel having its opening toward said one of said side walls;

wherein said first attachment surface defines a first slot therein such that a retainer button may be inserted through said first slot and a perforation in said side wall to substantially affix said first attachment surface to said side wall;

said first attachment surface further defining a countersink around said first slot;

wherein said first attachment surface further defines a second slot within said countersink, said first and second slots having substantially parallel, non-coincident longitudinal axes.

* * * * *